US006666152B2

(12) United States Patent
Tsai

(10) Patent No.: US 6,666,152 B2
(45) Date of Patent: Dec. 23, 2003

(54) FOLDABLE BANQUET TABLE

(76) Inventor: Frank Tsai, Tang-Jia Village, Gong Ming Town, Shenzhen City, Guand Dong (CN)

( * ) Notice: Subject to any disclaimer, the term of this patent is extended or adjusted under 35 U.S.C. 154(b) by 0 days.

(21) Appl. No.: 10/112,463

(22) Filed: Mar. 29, 2002

(65) Prior Publication Data

US 2003/0183135 A1 Oct. 2, 2003

(51) Int. Cl.[7] ..... A47B 3/00
(52) U.S. Cl. ..... 108/129; 108/161
(58) Field of Search ..... 108/132, 130, 108/124, 115, 161

(56) References Cited

U.S. PATENT DOCUMENTS 5,271,338 A * 12/1993 Bonham ..... 108/161
5,284,100 A * 2/1994 Thorn ..... 108/129
5,623,882 A * 4/1997 Price ..... 108/129
5,678,491 A * 10/1997 Price et al. ..... 108/115
5,694,865 A * 12/1997 Raab ..... 108/161
6,058,853 A * 5/2000 Pinch ..... 108/129
6,058,854 A * 5/2000 Tarnay et al. ..... 108/161
6,112,674 A * 9/2000 Stanford ..... 108/132
6,371,034 B1 * 4/2002 Simpson et al. ..... 108/129
6,431,092 B1 * 8/2002 Stanford ..... 108/132

FOREIGN PATENT DOCUMENTS

JP 60645 * 2/0000

* cited by examiner

*Primary Examiner*—Jose V. Chen
(74) *Attorney, Agent, or Firm*—Raymond Y. Chan; David and Raymond Patent Group

(57) ABSTRACT

A foldable banquet table includes a tabletop and a pair of table supporting frames mounted thereunder. The tabletop includes a top panel, a bottom panel overlappedly mounted to the top panel and defined a receiving cavity between the top and bottom panels, and a reinforcing frame which is received in the receiving cavity including a pair of reinforcing arms longitudinally positioned at two side edge portions of the receiving cavity respectively and at least two transverse supports spacedly connected between the two reinforcing arms. The table supporting frames are foldably mounted to the reinforcing frame at the bottom panel and adapted to fold in a folded position that the table supporting frames are pivotally and inwardly folded toward the bottom panel of the tabletop, and in the unfolded position, the table supporting frames are pivotally and outwardly folded to perpendicular to the tabletop.

20 Claims, 8 Drawing Sheets

FOLDABLE BANQUET TABLE

BACKGROUND OF THE PRESENT INVENTION

1. Field of Invention

The present invention relates to a banquet table, and more particularly to a foldable banquet table, which comprises a reinforced and lightweight rigid tabletop and a foldable leg frame connected thereto for enhancing the supporting structure and the portability of the foldable banquet table.

2. Description of Related Arts

Banquet tables have become very popular since the tables are economy, cheap and foldable that can be quickly and easily folded for carriage and storage and unfolded for use. Especially when some participant-intensive activities take place in multi-function rooms or designated areas, the banquet tables can be temporary set up in minutes. After the functions, the banquet tables can be quickly and neatly folded up for storage.

A conventional banquet table comprises a tabletop and a pair of table legs foldable mounted underneath the tabletop. For example, U.S. Pat. No. 5,957,061 generally suggests a banquet table that two table legs are pivotally mounted at two opposed side end portions of the tabletop. As shown in FIG. 1A, since the two table legs support the tabletop at two side end portions thereof, when a downward force is applied on the tabletop, a mid-portion of the tabletop may be cracked easily. In order to enhance the rigid structure of the banquet table, the tabletop must be made of stiffness material such as wood or metal. However, the wooden or metal tabletop will increase the overall weight of the banquet table that reduces the portability of the banquet table.

As shown in FIG. 1B, another U.S. Pat. No. 6,112,674, owned by Stanford, discloses a banquet table further comprising a pair of support braces each having a proximal end attached to one of the table leg and a distal end attached to a center of the tabletop in such a manner that when the table legs of the leg frame are perpendicularly unfolded to the tabletop, the support braces are inclinedly supported between the table legs and the tabletop to form a triangular support structure, so as to evenly distribute a weight loaded on the tabletop to the table legs. Since the support braces must be mounted to the center of the bottom surface of the tabletop, the length of the tabletop is limited by the length of the support brace. In other words, each of the support braces must be long enough to extend from the center of the tabletop to the respective table leg. Generally, the total length of the support braces is approximately 80% of the length of the tabletop. Therefore, in order to provide a longer banquet table, longer support braces must be incorporated therewith. Furthermore, since each support brace, having an unseasonable length, is inclinedly extended from the tabletop to the respective table leg, the leg room within the two table legs and the tabletop will be taken. Therefore, the user is unable to fully extend his or her leg within the leg room of the banquet table. So, such banquet table has disadvantage in practical use.

Thus, in order to enhance the portability of the banquet table, the tabletop is made of lightweight material such as plastic. One of the common technologies to manufacture the tabletop is known as the plastic "air-blow" molding technique. The tabletop generally comprises a top layer and a bottom layer integrally and overlappedly extended from the top layer to form a one-piece tabletop and define an air chamber between the top and bottom layers. The disadvantage of such hollow plastic tabletop is that each of the top and bottom layers is extremely difficult to have a uniform thickness during the manufacturing process. In other words, each of the top and bottom layers may have a thicker portion and a thinner portion. Once the thickness of each of the top and bottom layers is lesser than a safety thickness while there is no way to observe from exterior, the tabletop will be cracked easily at the thinner portion thereof when the weight is loaded on the tabletop.

In order to increase the strength of the tabletop, the leg frame must further comprises a supporting frame connected between the table legs and supported underneath the bottom layer of the tabletop. However, the reinforcing frame cannot strengthen the top layer as well. Thus, the attachments between the table legs, the reinforcing frame, and the bottom layer are relatively weak due to the physical structure of the tabletop. Moreover, it is very difficult for the manufacturer to rigidly fasten the table legs and the reinforcing frame to the thin plastic bottom layer of the tabletop. In other words, even though the plastic tabletop can enhance the portability of the banquet table, it cannot be too long in length. It also fails to provide a rigid support for compensating the original strength to support the weight loaded on the tabletop.

SUMMARY OF THE PRESENT INVENTION

A main object of the present invention is to provide a reinforced and lightweight rigid tabletop of a foldable banquet table to enhance the strength and rigidity of the foldable banquet table. In other words, the tabletop is adapted to rigidly support a weight loaded thereon comparing with a conventional plastic tabletop.

Another object of the present invention is to provide a foldable banquet table, wherein the tabletop is constructed to have a uniform thickness of a top panel and a bottom panel so as to evenly distribute the weight loaded on the tabletop. Moreover, the manufacturing process for making each of the top and bottom panels, having the uniform thickness, is extremely easy and simple that largely reduces the manufacturing cost of the foldable banquet table.

Another object of the present invention is to provide a foldable banquet table, wherein the tabletop further comprises a reinforcing frame built-in between the top and bottom panels to enhance the rigid structure of the top panel of the tabletop for supporting more weight thereon and the bottom panel for firmly and rigidly connecting and supporting the table legs therebelow. Moreover, the reinforcing frame provides a strong and rigid configuration of the tabletop so that a longer tabletop can be made without weakening its structure.

Another object of the present invention is to provide a foldable banquet table, wherein a supporting arm is inclinedly connected between the respective table leg frame and reinforcing frame at a side portion of the tabletop, but not the center thereof. Therefore, a longer tabletop can be manufactured without limited by the supporting arm.

Another object of the present invention is to provide a foldable banquet table, wherein the attachment between the tabletop and the table leg frames are pre-set at a predetermined position that the table leg frames are connected to the reinforcing frame but not the bottom panel. Therefore, the weight loaded on the top panel of the tabletop will be evenly distributed to the table leg frames.

Another object of the present invention is to provide a foldable banquet table, wherein the table leg frames are adapted to self-assemble to the tabletop. The tabletop and the table leg frames can be shipped and handled individually and then assembled later on by the importers or the customers in a Do-It-Yourself manner. Therefore, the handling and shipping cost of the foldable banquet table can be further reduced for the manufacturer. The shipping space can be reduced accordingly too. In other words, both the tabletop and the table leg frame are replaceable individually while the conventional banquet table must be thrown away when one of the parts is damaged.

Another object of the present invention is to provide a foldable banquet table which can be quickly and easily folded up for storage and carriage and unfolded for use.

Accordingly, in order to accomplish the above objects, the present invention provides a foldable banquet table which comprises a tabletop and a pair of table supporting frames adapted to foldably and spacedly affix to the tabletop.

The tabletop comprises a top panel, a bottom panel overlappedly connecting with the top panel in an edge to edge manner and defining a receiving cavity between the top and bottom panels, and a reinforcing frame, which is received in the receiving cavity, comprising a pair of reinforcing arms longitudinally supported and extended along two side edge portions of the receiving cavity respectively and at least two transverse supports spacedly connected between the two reinforcing arms.

Each of the table supporting frames comprises a leg frame pivotally affixed to the bottom panel of the tabletop and a retaining frame pivotally connected between the leg frame and the respective transverse support to retain the leg frame in an unfolded position, wherein in a folded position, the legs frames are pivotally and inwardly folded toward the bottom panel of the tabletop, and in the unfolded position, the leg frames are pivotally and outwardly folded to perpendicular to the tabletop.

DETAILED DESCRIPTION OF THE PREFERRED EMBODIMENT

Figure 1A:
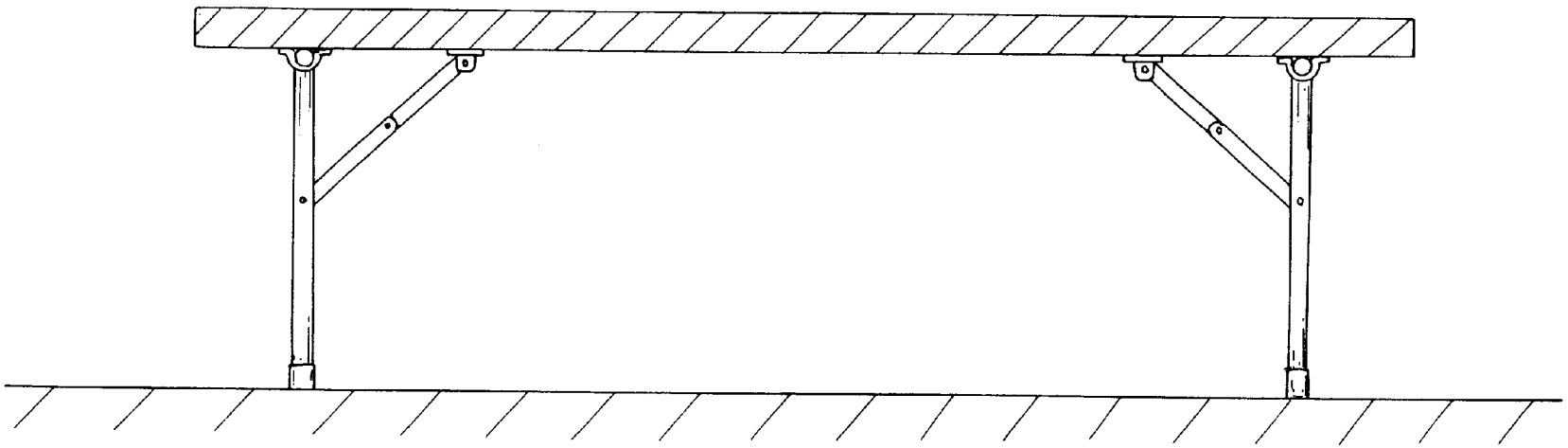
FIG. 1A PRIOR ART
FIG. 1A illustrates a conventional banquet table.
Figure 1B:
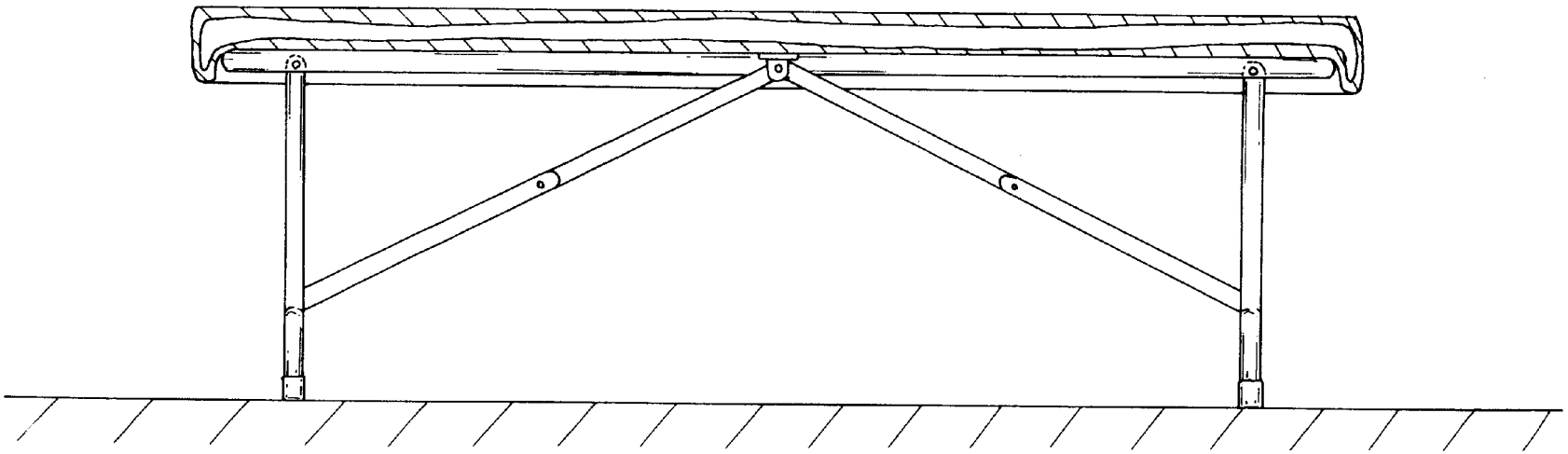
FIG. 1B PRIOR ART
FIG. 1B illustrates another conventional banquet table.
Figure 2:
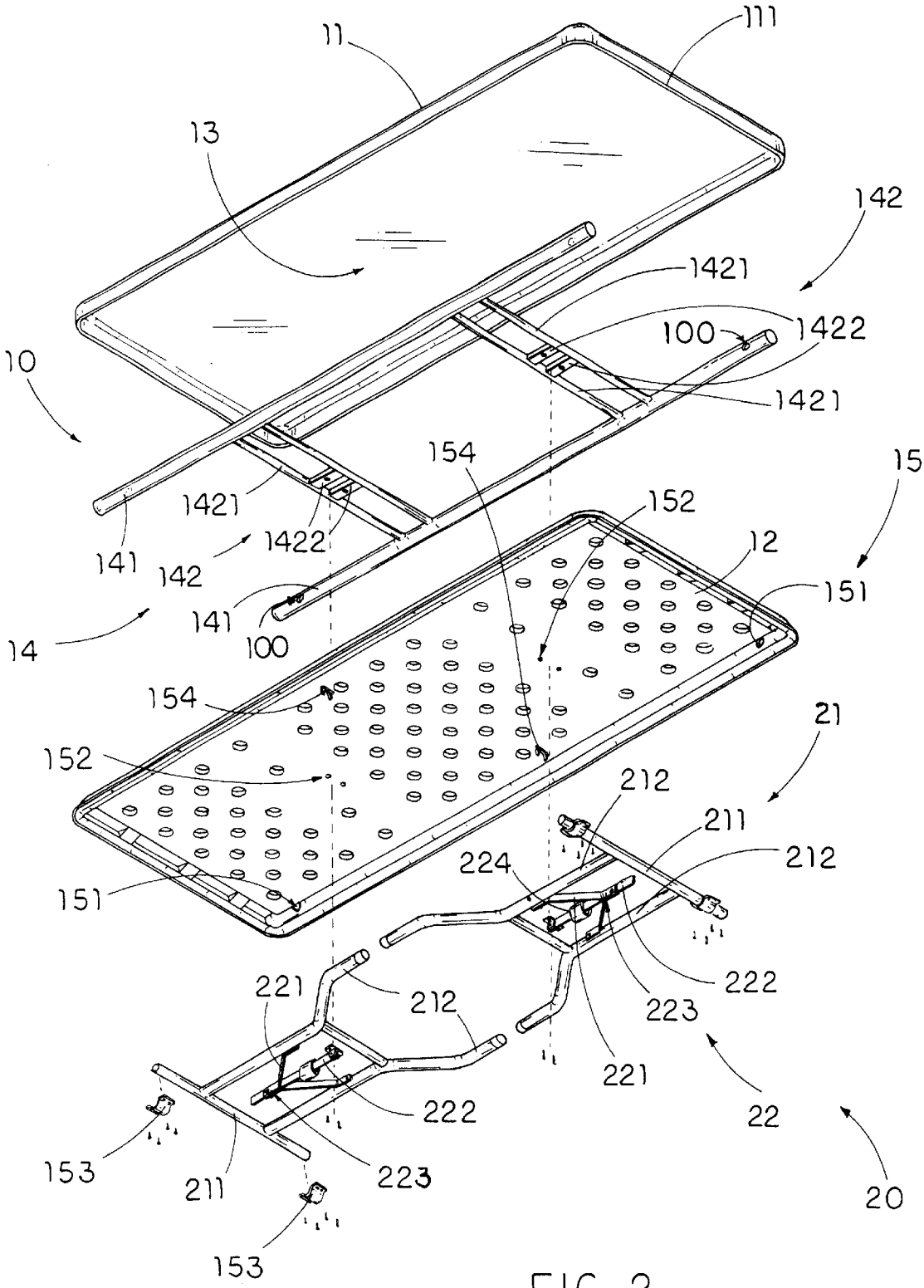
FIG. 2 is an exploded perspective view of a foldable banquet table according to a preferred embodiment of the present invention.

Referring to FIG. 2 of the drawings, a foldable banquet table according to a preferred embodiment of the present invention is illustrated, wherein the foldable banquet table comprises a tabletop 10 and a pair of table supporting frames 20 spacedly affixed to the tabletop 10.

The tabletop 10 comprises a plastic made top panel 11, a plastic made bottom panel 12 which is overlappedly connected with the top panel 11 in an edge to edge manner and defines a receiving cavity 13 between the top and bottom panels 11, 12, and a reinforcing frame 14, which is received in the receiving cavity 13, comprising a pair of reinforcing arms 141 longitudinally supported and extended along two side edge portions of the receiving cavity 13 respectively and at least two transverse supports 142 spacedly connected between the two reinforcing arms 141 respectively.

Figure 4:
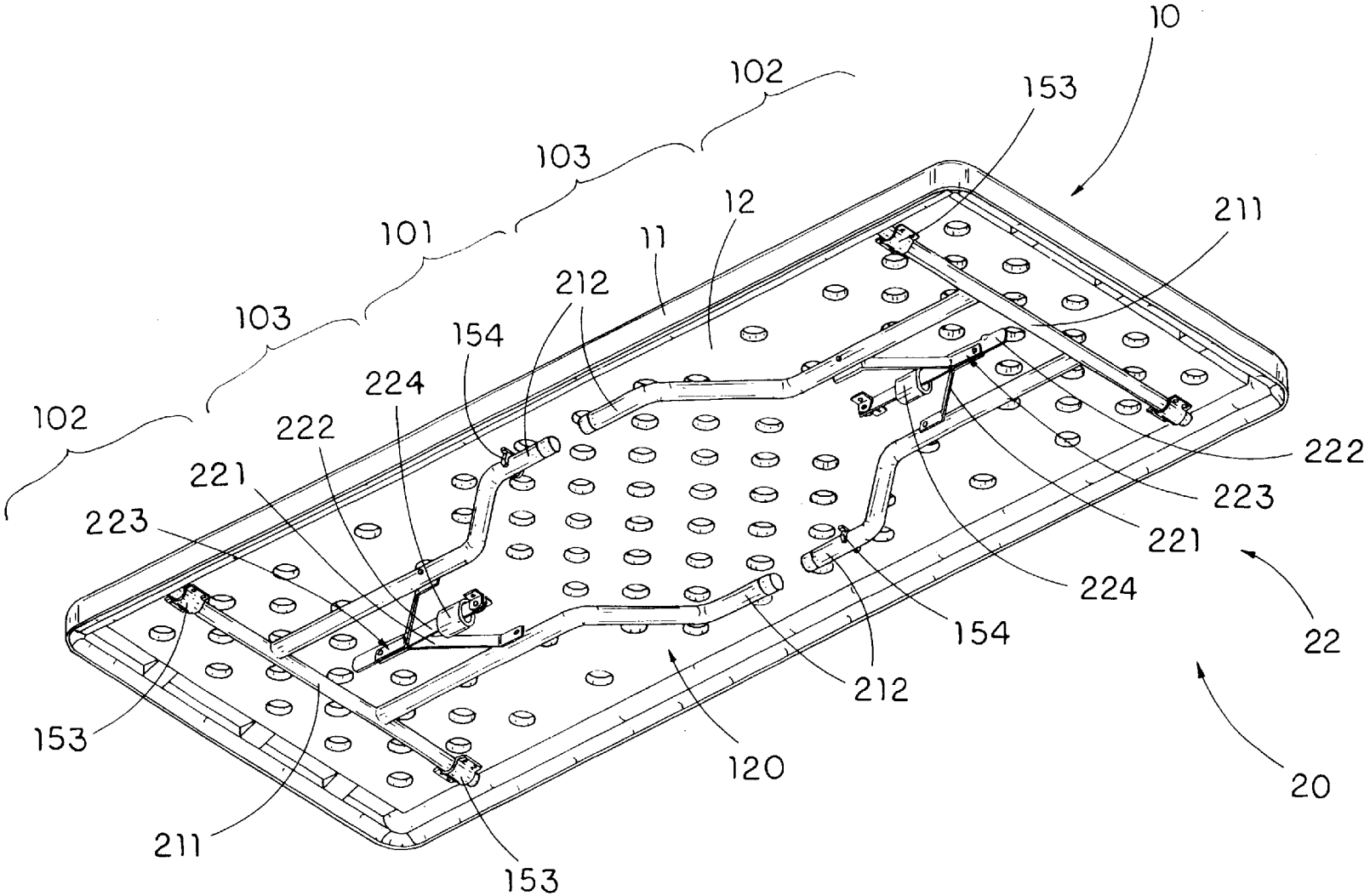
FIG. 4 is a perspective view of the foldable banquet table in a folded position according to the above preferred embodiment of the present invention.

Each of the table supporting frames 20 comprises a leg frame 21 pivotally attached to the bottom panel 12 of the tabletop 10 and a retaining frame 22 foldably connected between the leg frame 21 and the respective transverse support 142 to retain the leg frame 21 in an unfolded position, wherein in a folded position, as shown in FIG. 4, the leg frames 21 are pivotally and inwardly folded toward the bottom panel 12 of the tabletop 10, and in the unfolded position, the leg frames 21 are pivotally and outwardly folded to perpendicular to the tabletop 10.

As shown in FIG. 4, the tabletop 10 further has a transverse central portion 101, two transverse side end portions 102, and two transverse root portions 103 defined between the central portion 101 and the side end portions 102 respectively.

According to the preferred embodiment, the top panel 11 of the tabletop 10, having a rectangular shaped, is made by plastic molding or FRP to have a surrounding rim 111 downwardly extended from an edge of the top panel 11 respectively. The top panel 11 of the tabletop 10 is preferred made of lightweight but rigid material such as plastic.

The bottom panel 12 of the tabletop 10, having a corresponding rectangular shaped, is also made by plastic molding o FRP independently to have an edge portion 121 sealedly attached to inner side of the surrounding rim 111 of the top panel 11 by means of ultrasonic or other common sealing technologies such as thermal sealing, to form the receiving cavity 13 defined between the top panel 11 and the bottom panel 12 to receive the reinforcing frame 14 therein. It is worth to mention that both the top and bottom panels 11, 12 are manufactured individually, each of the top and bottom panels 11, 12 will have a uniform thickness, so as to ensure the strength of the top and bottom panels 11, 12 throughout the entire tabletop 10.

Moreover, when the bottom panel 12 is mounted to the top panel 11, a storage cavity 120 is defined within a lower portion of the surrounding rim 111 of the top panel 11 and the bottom panel 12 wherein the leg frames 21 of the table supporting frames 20 are arranged to folded inwardly to receive in the storage cavity 120 in the folded position.

Accordingly, each of the reinforcing arms 141 is an elongated member extended from one of the side end portion 102 of the tabletop 10 to another side end portion 102 thereof, so as to substantially enhance the rigid structure of the tabletop 10.

The two transverse supports 142 are positioned within the two root portions 103 of the tabletop 10 respectively, wherein each of the transverse supports 142 comprises a pair of support braces 1421 spacedly mounted between the two reinforcing arms 141 and a mounting member 1422 mounted between the two support braces 1421 for pivotally connecting with the respective retaining frame 22 of the table supporting frame 20.

The tabletop 10 further comprises an attachment arrangement 15 for mounting the table supporting frames 20 to the tabletop 10, wherein the attachment arrangement 15 contains four attachment holes 151 provided on two longitudinal edges of the bottom panel 12 within the side end portions 102 of said tabletop 10 respectively in such a manner that the leg frames 21 of the table supporting frames 20 are adapted to rotatably mount to the reinforcing arms 141 through the attachment holes 151 respectively.

Accordingly, each of the reinforcing arms 141 has two leg holes 100 provided on two inner side portions at positions aligning with the attachment holes 151 respectively so as to connect the leg frames 21 through the attachment holes 151.

The attachment arrangement 15 further contains at least two mounting holes 152 provided on the bottom panel 12 within the root portions 103 of the tabletop 10 respectively, wherein the mounting holes 152 are aligned with the mounting member 1422 of the transverse support 142, so that each of the retaining frames 22 is foldably connected between the respective leg frame 21 and the mounting member 1422 of the transverse support 142 through the respective mounting hole 152.

Figure 3A:
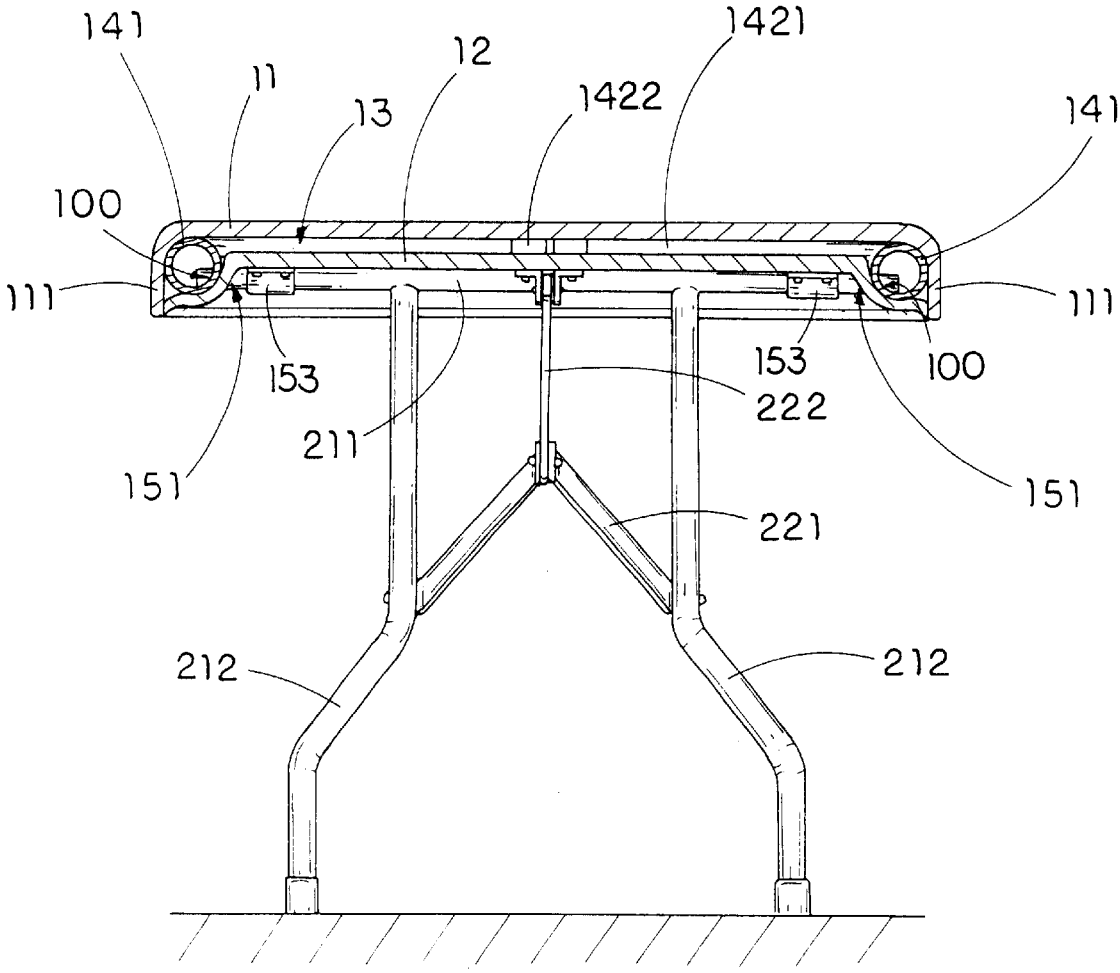
FIG. 3A is a sectional view of the foldable banquet table according to the above preferred embodiment of the present invention.

As shown in FIG. 3A, each of the leg frames 21 comprises two supporting legs 212 each having an upper end portion rotatably mounted to the respective reinforcing arm 141 through the respective attachment hole 151 and a transverse member 211 extended between the two supporting legs 212 in such a manner that the two supporting legs 212 are adapted to rotatably fold between the folded position and the unfolded position. Accordingly, the upper end portion of each supporting leg 212, having a corresponding size and shape, is arranged to rotatably insert into the respective leg hole 100 through the attachment hole 151 so as to connect the leg frame 21 to the tabletop 10.

Each of the retaining frames 22 comprises a first folding arm 221 pivotally connected to the respective leg frame 21, a second folding arm 223 pivotally connected to the respective mounting member 1422 of the transverse support 142 through the respective mounting hole 152 on the bottom panel 12, and a pivot joint 223 pivotally connected the first and second folding arms 221, 222 with each other in such a manner that when the leg frame 21 is folded perpendicularly to the tabletop 10, the first and second folding arms 221, 222 are pivotally extended to bias against the supporting legs 212 and the transverse supports 142 at the root portion 103 of the tabletop 10 respectively, so as to retain the leg frame 21 in the unfolded position Each of the retaining frames 22 further comprises a ring-shaped locker 224 slidably mounted to the second folding arm 222 for locking up the pivot joint 223 so as to prevent an unwanted pivotal movement of each of the first and second folding arms 221, 222 when the leg frame 21 is in the unfolded position.

The attachment arrangement 15 further comprises at least two U-shaped holding members 153 and at least two U-shaped holding clips 154. Each of the holding members 153 has two ends securely attached to the bottom panel 12 to define a guiding slot between the holding member 153 and the bottom panel 12 for the upper end portion of the supporting leg 212 passing through, so as to guide the folding operation of the supporting leg 212. Each of the holding clips 154 is mounted on the bottom panel 12 of the tabletop 10 and arranged in such a manner that when the leg frame 21 is folded toward the bottom panel 12, the supporting leg 212 is engaged with the holding clip 154 so as to hold the leg frame 21 in the folded position, as shown in FIG. 4.

Figure 3B:
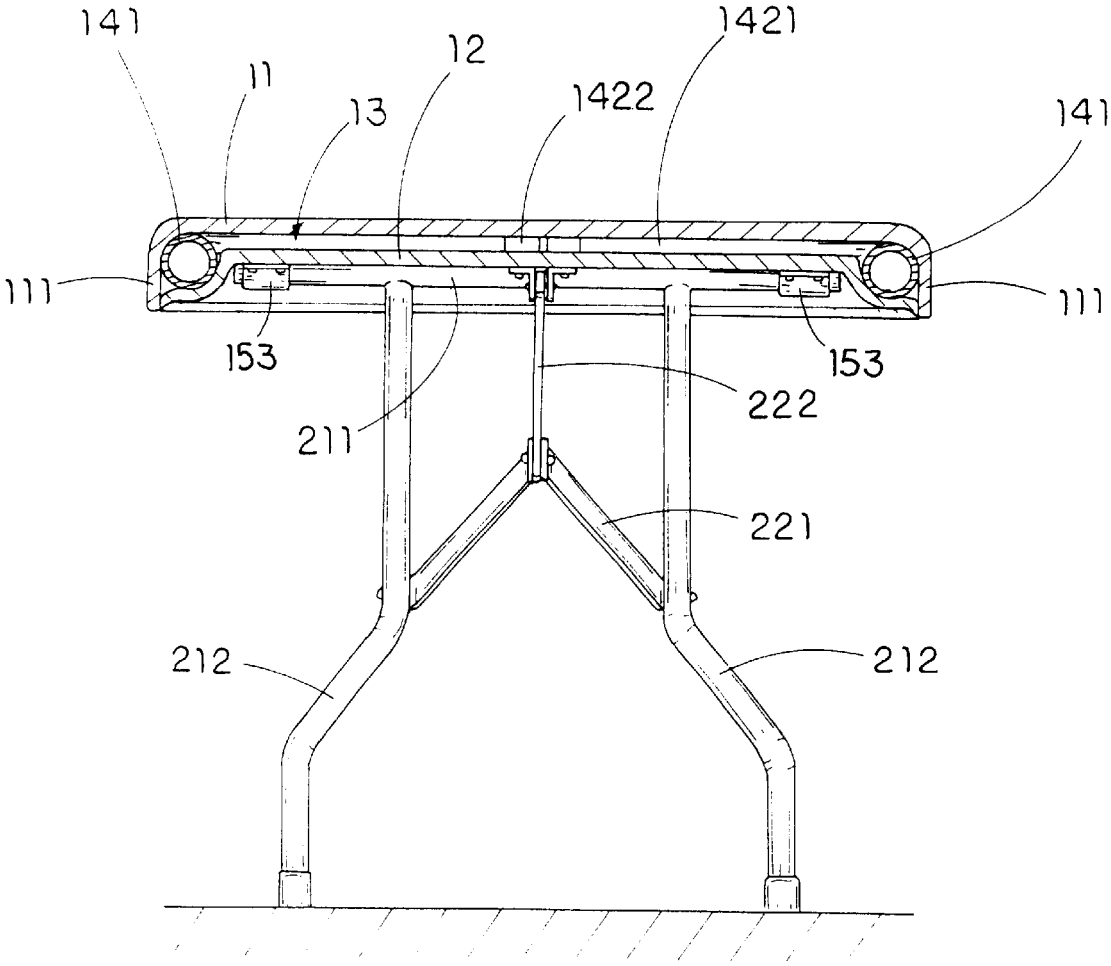
FIG. 3B illustrates an alternative attachment between the tabletop and the table supporting frames of the foldable banquet table according to the above preferred embodiment of the present invention.

Alternatively, the leg frames 21 are adapted to directly attach to the bottom panel 12 by mounting the two holding clips 154 to the upper end portions of the supporting legs 212 on the bottom panel 12, as shown in FIG. 3B. In other words, no attachment hole 151 and leg hole 100 is required in order to connect the leg frame 21 to the tabletop 10, so as to simplify the assembly operation of the foldable banquet table of the present invention.

Figure 5:
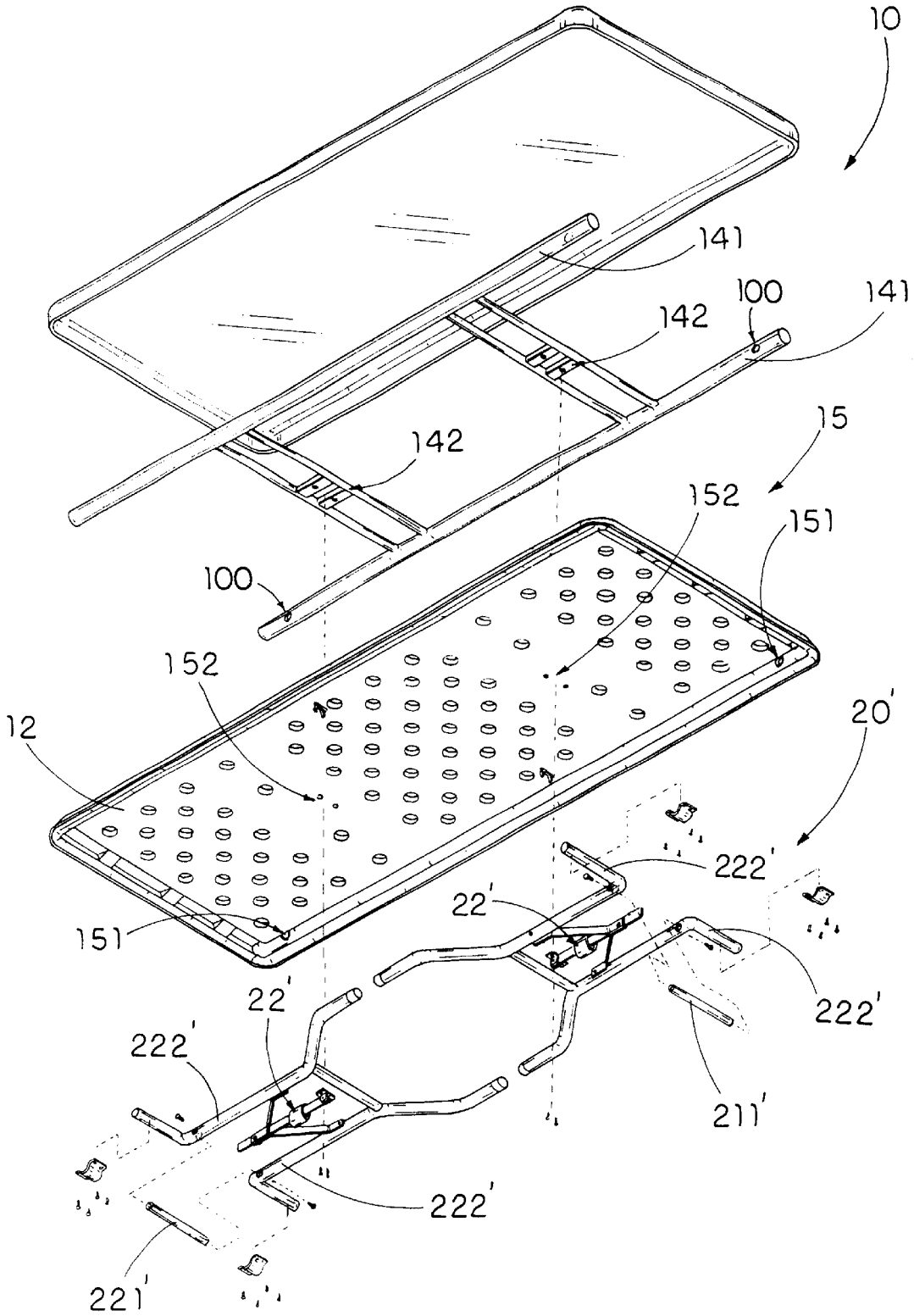
FIG. 5 illustrates an alternative mode of a table supporting frame of the foldable banquet table according to above preferred embodiment of the present invention.

FIG. 5 illustrates an alternative mode of the table supporting frame 20' which is adapted to detachably attach to the tabletop 10 in such a manner that the user is able to assemble the foldable banquet table by himself or herself.

As shown in FIG. 5, the transverse member 211' is detachably attached between the two supporting legs 222' by means of connecting elements such as screws in such a manner that each supporting leg 222' is adapted to rotatably mount to the respective reinforcing arm 141 by rotatably inserting the upper end portion of the supporting leg 222' into the leg hole 100 on the reinforcing arm 141 through the attachment hole 151 on the bottom panel 12 and attaching the retaining frames 22' to the transverse supports 142 through the mounting holes 152 respectively. Then the transverse member 211' is adapted to mount between two adjacent supporting legs 222'. It is worth to mention that since the attachment arrangement 15 is pre-set on the bottom panel 12 of the tabletop 10, the table supporting frames 20' are adapted to attach to or detach from the tabletop 10. In other words, the user is able to replace the tabletop 10 and/or the table supporting frame 20' if necessary.

Figure 6:
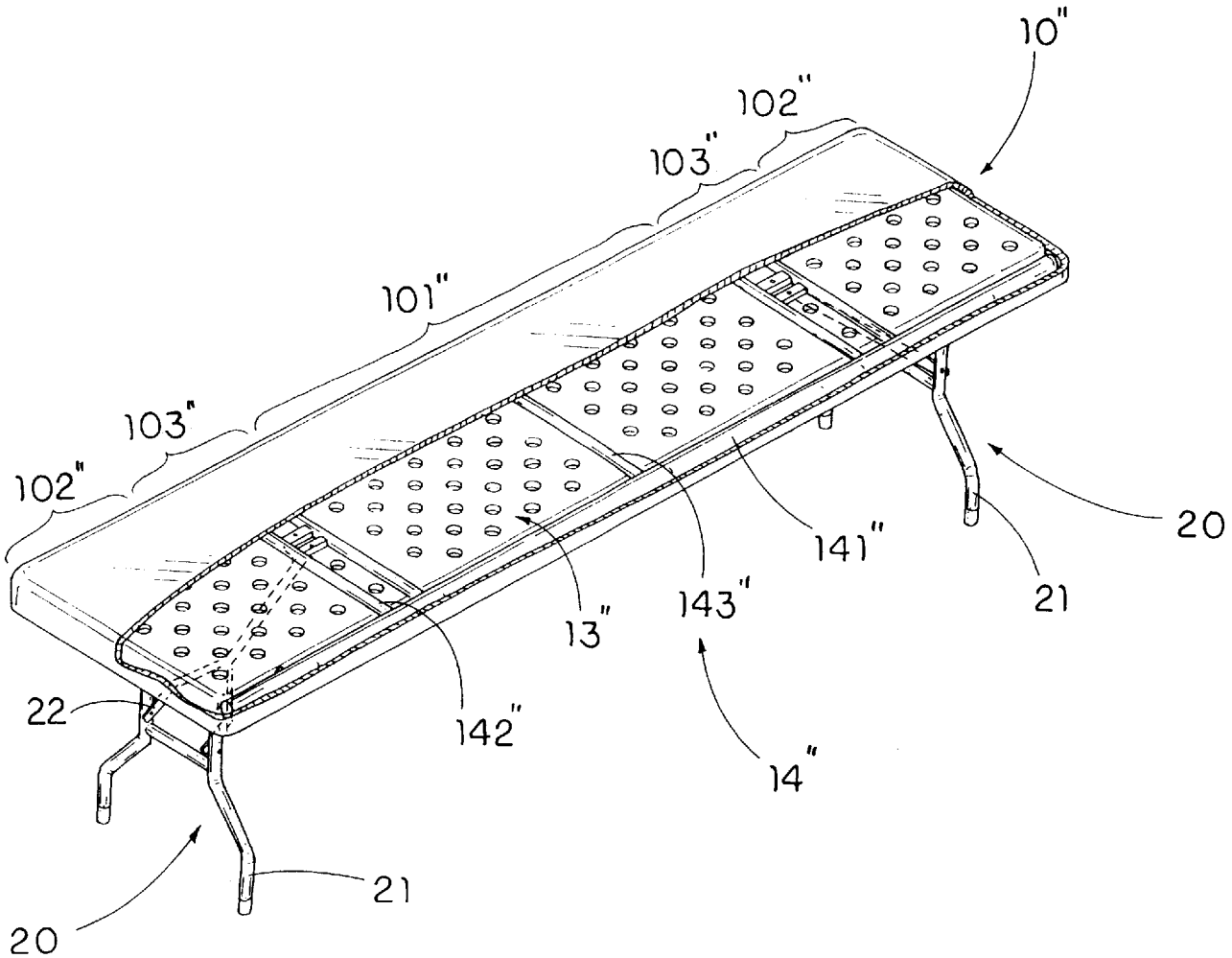
FIG. 6 illustrates an alternative mode of a tabletop of the foldable banquet table according to the above preferred embodiment of the present invention.

FIG. 6 illustrates an alternative mode of the tabletop 10" wherein the tabletop 10" is adapted to be prolonged its length without altering the structure of the table supporting frame 20. As it is mentioned that since the leg frame 21 of the preferred embodiment are attached to the side end portions 102" of the tabletop 10" respectively and the retaining frames 22 are connected to the root portion 103" of the tabletop 10", the tabletop 10" is adapted to increase its length by increasing the length the central portion 101" thereof. In order to strengthen the central portion 101" of the tabletop 10", the reinforcing frame 14" further comprises at least an auxiliary transverse support 143" which is received in the receiving cavity 13" and extended between the reinforcing arms 141' at a position within the central portion 101'. Therefore, the tabletop 10" can substantially increase its length without reducing the strength thereof It is worth to mention that when incorporating with the table supporting frames 20' as disclosed in the alternative, the user is able to interchange both tabletop 10" and the table supporting frames 20'. In other words, the user is able to select the longer tabletop 10" or the shorter tabletop 10 for the table supporting frame 20' installing thereinto.

What is claimed is:

1. A foldable banquet table, comprising:

a tabletop comprising a plastic made top panel, a plastic made bottom panel which is overlappedly connected with said top panel in an edge to edge manner and defines a receiving cavity between said top and bottom panels, and a reinforcing frame which is received in said receiving cavity comprising a pair of reinforcing arms longitudinally supported and extended along two side edge portions of said receiving cavity respectively and at least two transverse supports spacedly connected between said two reinforcing arms; and a pair of table supporting frames foldably and spacedly affixed to said tabletop, wherein each of said table supporting frames comprises a leg frame pivotally attached to said bottom panel of said tabletop and a retaining frame foldably connected between said leg frame and said respective transverse support to retain said leg frame in an unfolded position, wherein each of said leg frames has an upper end portion rotatable mounted between said two reinforcing arms and each of said retaining frames comprises a first folding arm and a second folding arm, wherein said two first folding arms of said two retaining frames are pivotally connected to said two leg frames respectively and said two second folding arms are pivotally connected to said two transverse supports respectively, so as to rigidly support and mount said leg frames to said reinforcing arms and said transverse supports of said tabletop in such a manner that in a folded position, said leg frames are pivotally and inwardly folded toward said bottom panel of said tabletop, and in an unfolded position, said leg frames are pivotally and outwardly folded to perpendicular to said tabletop and firmly and rigidly supported by said transverse supports through said two retaining frames respectively.

2. The foldable banquet table, as recited in claim 1, wherein said tabletop further has a transverse central portion, two transverse side end portions, and two transverse root portions defined between said central portion and said side end portions respectively, wherein each of said reinforcing arms is extended from one of said side end portion to another side end portion, and said two transverse supports are positioned with said two root portions respectively.

3. The foldable banquet table, as recited in claim 1, wherein each of said transverse supports comprises a mounting member and said two second folding arms of said two retaining frames are pivotally connected to said two mounting members of said two transverse supports respectively.

4. The foldable banquet table, as recited in claim 2, each of said transverse supports comprises a mounting member and said two second folding arms of said two retaining frames are pivotally connected to said two mounting members of said two transverse supports respectively.

5. The foldable banquet table, as recited in claim 3, wherein each of said transverse supports further comprises a pair of support braces and said respective mounting member is mounted between said two support braces.

6. The foldable banquet table, as recited in claim 4, wherein each of said transverse supports further comprises a pair of support braces and said respective mounting member is mounted between said two support braces.

7. The foldable banquet table, as recited in claim 4, wherein said tabletop further comprises an attachment arrangement for mounting said table supporting frames to said tabletop, wherein said attachment arrangement contains four attachment holes provided on two longitudinal edges of said bottom panel within said side end portions of said tabletop respectively in such a manner that said leg frames of said table supporting frames are adapted to rotatably mount to said reinforcing arms through said attachment holes respectively, wherein each of said reinforcing arms has two holes provided on two inner side portions at positions aligning with said attachment holes respectively and each of said leg frames comprises two supporting legs each having an upper end portion rotatable mounted to said respective reinforcing arm through said respective attachment hole so as to connect said leg frame to said tabletop.

8. The foldable banquet table, as recited in claim 6, wherein said tabletop further comprises an attachment arrangement for mounting said table supporting frames to said tabletop, wherein said attachment arrangement contains four attachment holes provided on two longitudinal edges of said bottom panel within said side end portions of said tabletop respectively in such a manner that said leg frames of said table supporting frames are adapted to rotatably mount to said reinforcing arms through said attachment holes respectively, wherein each of said reinforcing arms has two holes provided on two inner side portions at positions aligning with said attachment holes respectively and each of said leg frames comprises two supporting legs each having an upper end portion rotatable mounted to said respective reinforcing arm through said respective attachment hole so as to connect said leg frame to said tabletop.

9. The foldable banquet table, as recited in claim 7, wherein said upper end portions of said two supporting legs of each of said leg frames are rotatable inserted into said leg holes through said attachment holes respectively in such a manner that said two supporting legs are adapted to rotatably fold between said folded position and said unfolded position.

10. The foldable banquet table, as recited in claim 8, wherein said upper end portions of said two supporting legs of each of said leg frames are rotatable inserted into said leg holes through said attachment holes respectively in such a manner that said two supporting legs are adapted to rotatably fold between said folded position and said unfolded position.

11. The foldable banquet table, as recited in claim 4, wherein said attachment arrangement further contains at least two mounting holes provided on said bottom panel within said root portions of said tabletop respectively, wherein each of said retaining frames is foldably connected between said respective leg frame and said transverse support through said mounting hole, wherein said two second folding arms are pivotally connected tow said two mounting members of said two transverse supports through said mounting holes on said bottom panel respectively.

12. The foldable banquet table, as recited in claim 8, wherein said attachment arrangement further contains at least two mounting holes provided on said bottom panel within said root portions of said tabletop respectively, wherein each of said retaining frames is foldably connected between said respective leg frame and said transverse support through said mounting hole, wherein said two second folding arms are pivotally connected tow said two mounting members of said two transverse supports through said mounting holes on said bottom panel respectively.

13. A tabletop for a foldable banquet table having two retaining frames foldably supporting two leg frames respectively thereto, wherein said tabletop comprises:

a plastic made top panel;

a plastic made bottom panel which is overlappedly connected with said top panel in an edge to edge manner and defines a receiving cavity between said top and bottom panels; and a reinforcing frame which is received in said receiving cavity comprising a pair of reinforcing arms longitudinally supported and extended along two side edge portions of said receiving cavity respectively for the two leg frames to rotatable mounted therebetween, and at least two transverse supports spacedly connected between said two reinforcing arms for the two retaining frames to pivotally connected thereto so as to rigidly support and mount the two leg frames to the reinforcing arms and the transverse supports in such a manner that in a folded position, the leg frames are pivotally and inwardly folded toward said bottom panel of said tabletop, and in an unfolded position, the leg frames are pivotally and outwardly folded to perpendicular to said tabletop and firmly and rigidly supported by said transverse supports through the two retaining frames respectively.

14. The tabletop, as recited in claim 13, further having a transverse central portion, two transverse side end portions, and two transverse root portions defined between said central portion and said side end portions respectively, wherein each of said reinforcing arms is extended from one of said side end portion to another side end portion, and said two transverse supports are positioned with said two root portions respectively.

15. The tabletop, as recited in claim 13, wherein each of said transverse supports comprises a mounting member and said two folding arms of said two retaining frames are pivotally connected to said two mounting members of said two transverse supports respectively.

16. The tabletop, as recited in claim 14, wherein each of said transverse supports comprises a mounting member and said two folding arms of said two retaining frames are pivotally connected to said two mounting members of said two transverse supports.

17. The tabletop, as recited in claim 16, wherein each of said transverse supports further comprises a pair of support braces and said respective mounting member is mounted between said two support braces.

18. The tabletop, as recited in claim 17, wherein said attachment arrangement further contains at least two mounting holes provided on said bottom panel respectively, adapted for connecting said retaining frames to said transverse supports through said mounting holes respectively.

19. The tabletop, as recited in claim 15, further comprising an attachment arrangement for mounting the table supporting frames to said tabletop, wherein said attachment arrangement contains four attachment holes provided on two longitudinal edges of said bottom panel within said side end portions of said tabletop respectively for rotatable mounting the leg frames of the table supporting frames to said reinforcing arms through said attachment holes respectively, wherein each of said reinforcing arms has two holes provided on two inner side portions at positions aligning with said attachment holes respectively each for rotatable mounting an upper end of a supporting leg of the leg frame to said respective reinforcing arm through said respective attachment hole.

20. The tabletop, as recited in claim 18, further comprising an attachment arrangement for mounting the table supporting frames to said tabletop, wherein said attachment arrangement contains four attachment holes provided on two longitudinal edges of said bottom panel within said side end portions of said tabletop respectively for rotatably mounting the leg frames of the table supporting frames to said reinforcing arms through said attachment holes respectively, wherein each of said reinforcing arms has two holes provided on two inner side portions at positions aligning with said attachment holes respectively each for rotatable mounting an upper end of a supporting leg of the leg frame to said respective reinforcing arm through said respective attachment hole.

* * * * *